US005183194A

United States Patent [19]

Shirdavani

[11] Patent Number: 5,183,194

[45] Date of Patent: Feb. 2, 1993

[54] GARMENT WEIGHT TRANSFER APPARATUS

[76] Inventor: Hossain A. Shirdavani, 14425 NE. 37th Pl., Bellevue, Wash. 98007

[21] Appl. No.: 816,617

[22] Filed: Dec. 31, 1991

[51] Int. Cl.[5] ..... A45F 3/00

[52] U.S. Cl. ..... 224/224; 2/45

[58] Field of Search ..... 224/224, 186, 187, 265, 224/261, 213, 910, 216, 157, 189, 44.5, 160, 184, 188, 189, 190, 266, 270; 2/2, 44, 45, 267, 268

[56] References Cited

U.S. PATENT DOCUMENTS

| | | | |
|---|---|---|---|
| 1,469,111 | 9/1923 | Russell | 224/187 |
| 1,627,847 | 5/1927 | Harold | 224/187 |
| 2,464,352 | 4/1946 | Simon | 224/187 |
| 3,021,985 | 2/1962 | Sarver | 224/187 |
| 3,039,765 | 6/1962 | Tate | 269/3 |
| 4,114,788 | 9/1978 | Zufich | 224/216 |
| 4,894,868 | 1/1990 | Christopher | 2/268 |
| 5,035,523 | 7/1991 | Allinder | 224/229 |

*Primary Examiner*—Henry J. Recla
*Assistant Examiner*—David J. Walczak
*Attorney, Agent, or Firm*—Robert W. Jenny

[57] ABSTRACT

The apparatus relieves the weight of a garment from a wearer's shoulders and transfers the weight to the wearer's midsection, specifically the hips. The apparatus comprises a padded saddle adjustable to conform to the wearer's hips, adjustable length uprights attached to the saddle and supporting shoulder guards, pads and a strap to hold the uprights near to but not touching the wearer's back. The uprights are adjusted so that the shoulder guards are close to but not touching the wearer's shoulders.

1 Claim, 1 Drawing Sheet

GARMENT WEIGHT TRANSFER APPARATUS

BACKGROUND OF THE INVENTION

1. Field

The subject apparatus is in the field of apparatus used to facilitate support of weight by the human body, weight such as that of back packing gear, scuba diving gear and the like. Specifically it is in the field of such apparatus used to support the weight of heavy garments used by workmen, firefighters and various construction workers. More specifically it is in the field of weight transfer apparatus used with lead filled garments used to shield the wearer from radiation in various laboratories.

2. Prior Art

A preliminary search of the prior art in this specific field produced several patents for garments containing radiation shielding but none relating to apparatus for transferring the weight of such garments from the wearer's shoulders to the wearer's hips. Such transference is advantageous because it relieves the wearer's spinal column from the stress and strain of bearing the garment weight and also allows greater freedom of use of the wearer's arms.

Accordingly, the primary objective of the subject invention is to provide apparatus for holding the weight of a garment off of the shoulders of a person wearing the garment and transferring it to the wearer's midsection, particularly the hips. Other objectives are that the apparatus be comfortable, easy to put on and remove and easily adjustable to conform to the size and shapes of wearers.

SUMMARY OF THE INVENTION

The subject invention is apparatus for transferring the weight of a garment from the wearer's shoulders to the wearer's midsection. The apparatus comprises a specially shaped, adjustable belt, termed a saddle for the purposes of this disclosure, adjustable upright members attached to the saddle, pads and straps for holding the uprights near to but not touching the wearer's back and shoulder guards attached to the upper portions of the uprights. The uprights are adjustable in length to hold the garment close to but not touching the wearer's shoulders, accounting for the variation among wearers of the distances from hips to shoulders. The saddle is adjustable both in front and back to enable accomodation of the variation in girth among wearers while positioning the primary pads in the saddle over the wearer's hips. The uprights are detachably attached to the saddle, their lower ends fitting into brackets on or sockets in the saddle.

In use the saddle is adjusted to position the primary pads over the wearer's hips. The uprights are adjusted to suit the wearer's conformation, the lower ends of the uprights being attached to the saddle. Straps attached to the uprights are passed under the wearer's armpits and adjustably attached and adjusted to hold the pads of the uprights comfortably against the wearer's back in the general area of the shoulder blades. The garment can then be donned with the shoulder guards of the apparatus supporting the garment by its shoulder portions.

The invention is described in more detail below with reference to the attached drawings.

DETAILED DESCRIPTION OF THE INVENTION

Figure 1:
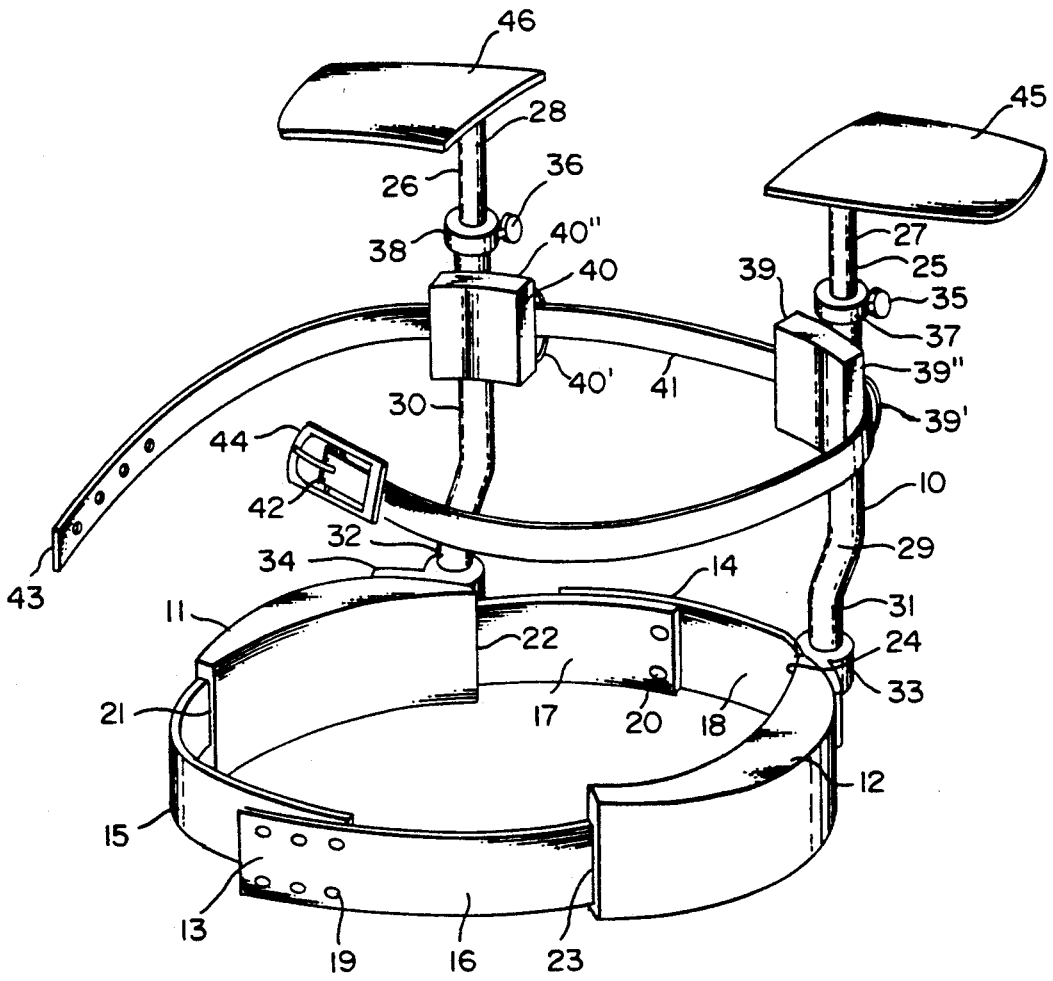
FIG. 1 is a perspective view of the subject apparatus.

The subject invention is an apparatus for transferring the weight of a garment from a wearer's shoulders to the wearer's midsection, specifically hips. Referring to FIG. 1, the apparatus 10 comprises shaped pads 11 and 12 attached to each other by adjustable belts 13 and 14. The pads have a shallow cupped shape and are flexible such that they can bend around the wearer's body. The belts are made adjustable by having adjustable fastenings of their segments 15 and 16 and 17 and 18, using any appropriate fastening techniques such as buckles, Velcro TM or snap fasteners, snap fasteners being shown in this embodiment. Fastener components 19 and 20 are typical. The belt segments are shown attached to ends 21 and 22 on pad 11 and ends 23 and 24 on pad 12.

The apparatus also comprises upright assemblies 25 and 26. Upper segments 27 and 28 of the segments slide telescopically into the lower segments 29 and 30 so that the lengths of the uprights are adjustable. Lower ends 31 and 32 of the lower segments fit into sockets 33 and 34 in the pads. The pads and belt segments are termed a saddle for purposes of this disclosure. The adjustments are set by tightening thumbscrews 35 and 36 in collars 37 and 38. Pads 39 and 40 are attached to the uprights and strap 41 passes through loops attached to the backs of the pads, loop 39' on back 39'' on pad 39 and loop 40' on back 40'' on pad 40. The pads are thus slidably attached to the strap. The ends 42 and 43 of the belt are adjustably and detachably attached by buckle 44. The strap and pads hold the uprights close to but not touching a wearer's back.

Shoulder guards 45 and 46 are attached to the upper ends (not visible in this view) of segments 27 and 28 respectively. In use, with the apparatus adjusted to suit a particular wearer, the shoulder guards are close to but not touching the wearer's shoulders and the weight of a garment worn by the wearer is carried on the guards and transferred by the apparatus to the wearer's midsection.

It is considered to be understandable from this description that the subject invention meets its objectives. It provides apparatus for holding the weight of a garment off the wearer's shoulders and transferring the weight to the wearer's midsection. The apparatus is comfortable, easy to put on and remove and is easily adjustable to conform to the sizes and shapes of wearers.

It is also considered to be understood that while one embodiment of the invention is described herein, other embodiments and modifications of the one described are possible within the scope of the invention which is limited only by the attached claims.

I claim:

1. Garment weight transfer apparatus, said apparatus comprising:

a saddle, comprising first and second pads, each of said pads having first and second ends, and first and second adjustable belts, said first belt interconnecting said first ends of said pads, said second belt interconnecting said second ends of said pads, first and second adjustable length uprights, each of said uprights having a top end and a bottom end, first and second shoulder guards, said bottom ends of said uprights being attached to said saddle said top end of said first upright being attached to said first shoulder guard and said top end of said second upright being attached to said second shoulder guard wherein said shoulder guards are sized and adapted to be spaced above and extend laterally across the tops of the shoulders of a nearer, third and fourth pads and a strap, said third and fourth pads being slidably attached to said strap, said third pad being attached to said first upright and said fourth pad being attached to said second upright.

* * * * *